United States Patent [19]

Lee et al.

[11] Patent Number: 4,512,235

[45] Date of Patent: Apr. 23, 1985

[54] STRESS LIMITED CARTRIDGE RELOADING PRESS

[76] Inventors: Richard J. Lee, 3146 Kettle Moraine Rd.; John D. Lee, 3086 Kettle Moraine Rd., both of, Hartford, Conn. 53027

[21] Appl. No.: 564,182

[22] Filed: Dec. 22, 1983

[51] Int. Cl.[3] ..... F42B 33/02

[52] U.S. Cl. ..... 86/23; 86/24; 86/25; 86/37; 86/40

[58] Field of Search ..... 86/23, 24, 28, 33, 37, 86/40, 25, 43

[56] References Cited

U.S. PATENT DOCUMENTS

| | | | |
|---|---|---|---|
| 2,819,644 | 1/1958 | Corcoran | 86/23 |
| 2,847,895 | 8/1958 | Huntington, et al. | 86/23 |
| 3,603,199 | 9/1971 | Corcoran | 86/24 |
| 4,133,249 | 1/1979 | Bachhuber, et al. | 86/36 |
| 4,222,305 | 9/1980 | Lee | 86/37 |
| 4,331,063 | 5/1982 | Schaenzer | 86/36 |
| 4,375,778 | 3/1983 | Ryan | 86/25 |
| 4,393,744 | 7/1983 | Lee | 86/36 |
| 4,418,606 | 12/1983 | Lee | 86/23 |

*Primary Examiner*—Stephen J. Lechert, Jr.
*Assistant Examiner*—Howard J. Locker
*Attorney, Agent, or Firm*—Fuller, House & Hohenfeldt

[57] ABSTRACT

An ammunition case reloading press is based on an O-frame die cast from a low strength metal. A case carrying ram is driven reciprocably through a bottom member of the O-frame toward and away from a die in a top member. A compound lever system is actuated by a manual operating arm to drive the ram. A stop prohibits the links of the lever system from toggling into dead center position to thereby limit the stress of the O-frame. The operating arm is designed so it will flex to signal the user that unnecessarily great resistance is being offered and that the die should be adjusted relative to the ram to reduce the stress. The operating arm and lever system pivots are askew to a vertical plane passing through the frame so the arm swings clear past the side of the O-frame and so there is a clearer line of sight to the opening in the O-frame where the cases are placed on and removed from the ram.

11 Claims, 7 Drawing Figures

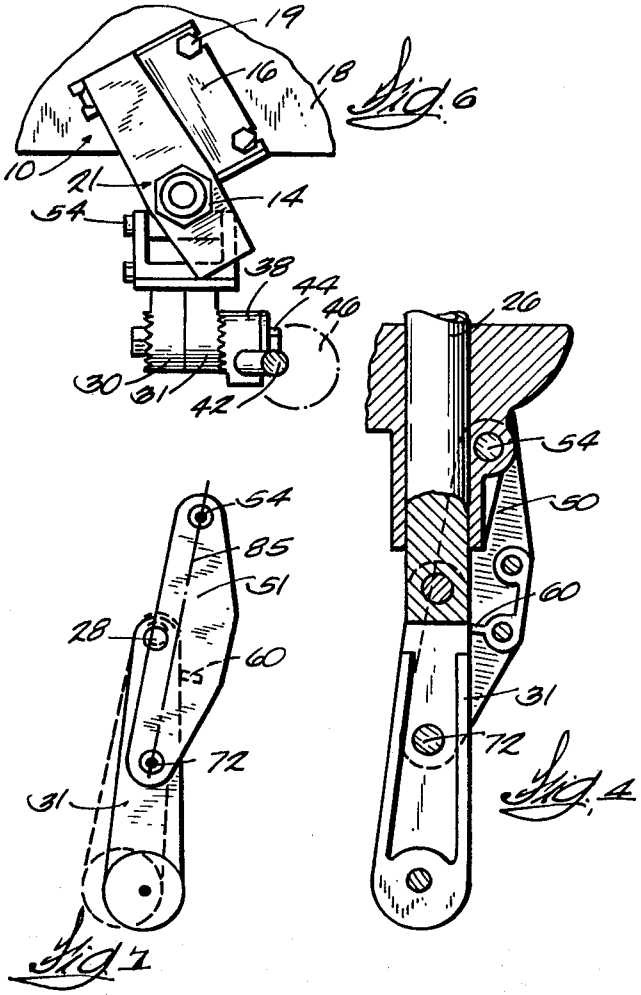
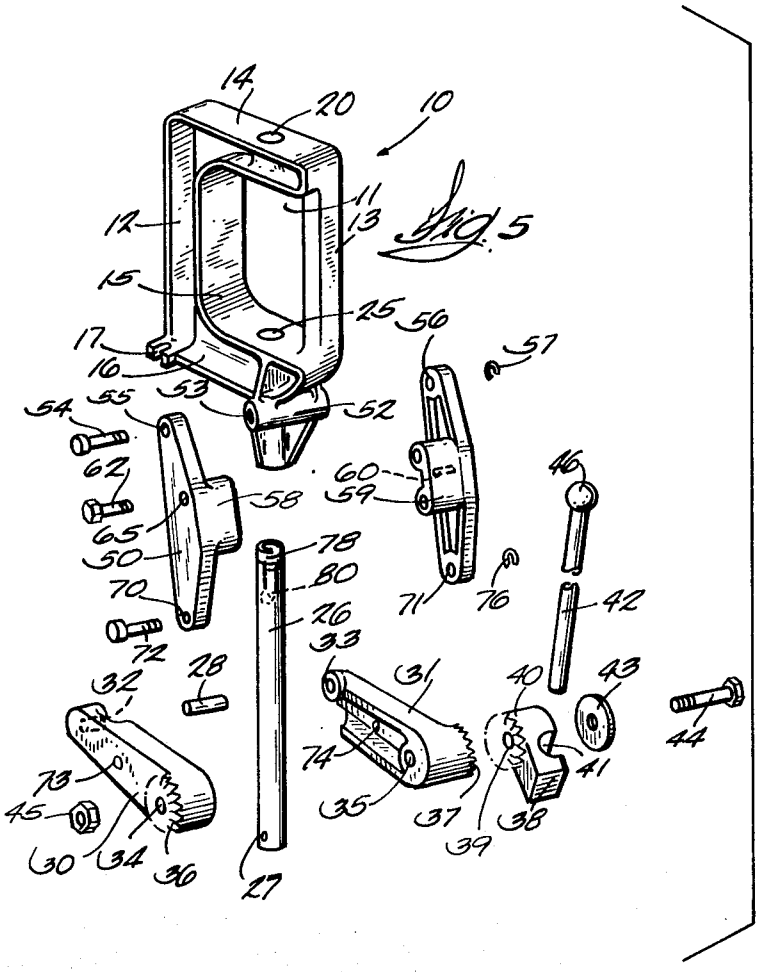

STRESS LIMITED CARTRIDGE RELOADING PRESS

BACKGROUND OF THE INVENTION

This invention relates to a press for full length resizing cartridge cases, removing primers, reseating new bullets in the neck ends and inserting a new primer in the socket at the head end of a case.

Typically, cartridge case reloading presses comprise a frame and a vertically reciprocable ram slideable in the frame toward and away from one or more dies into which a case is pressed by the ram for the purpose of performing such reloading operations as expelling the spent primer, resizing the case and pressing and crimping a new bullet in the case. In several types of reloading presses, the ram is driven by means of linkages comprising a compound lever system which is actuated by an arm that is swung by the user. Commonly, in prior art presses, an objective is to have the compound lever links toggle into a top dead center condition as the case is being pressed into the die so the highest possible force is applied to the case. Of all the reloading steps, the greatest amount of force is usually needed for the case resizing operation. A force on the ram of 100–1,500 pounds has been found to be sufficient to resize the largest cases used in ammunition available to civilians. Nevertheless, the makers of some presses now on the market claim that their frame and links are designed to withstand as much as 80,000 pounds of force which is far in excess of the force required for any of the case reloading operations. It has been observed that the reason for press manufacturers making each new model stronger than the last is that they are trying to prevent fractures or failure of the press parts resulting from misuse of the press. The most commonly occurring misuse is screwing in or adjusting a die relative to the ram such that the linkages driving the ram are toggling into their dead center condition as the case on the ram reaches the limit of its travel in the die. As the linkages of the compound lever system pass dead center, mechanical advantages approach infinity and a force is developed which can damage any press regardless of how strongly it is built. In reality it is only the spring or small elastic yield in the press frame and linkages that saves the press from destroying itself in most designs although damage occurs all too frequently in some brands of presses. As manufacturers attempt to strengthen some parts of the press, other parts ultimately take more of the load and yield to the overstress. Some presses now on the market claim a mechanical advantage of 189:1 just before toggling into dead center. Assuming that a user had adjusted a die too deeply and pushed the operating lever with a force of 75 pounds, the ram force could be on the order of 14,000 pounds or 10 times more than would ordinarily be necessary to size the largest cases commonly used by civilians. Thus, the prior art presses must be strong enough to withstand nearly 7 tons of force with no real benefit except to allow a user to use it improperly without having it fail. Except for the new reloading press disclosed herein, press manufacturers address the problem by making the parts of each new generation of presses of tougher and heavier steel forgings and castings. As a result, presses are becoming heavier, larger and more expensive.

SUMMARY OF THE INVENTION

An object of the present invention is to provide a cartridge case reloading press that is based on use of a relatively weak frame and reverses the trend exhibited in prior art press designs of using stronger and stronger frames. This is made possible by designing the press with two important characteristics. The first is to limit the input force by means of a lever that will flex to alert the operator excessive force is being applied. Additional force will bend the lever but not transmit the force through the linkage. The second is to limit the mechanical advantage with a stop for the ram operating linkage which prevents the linkage from toggling to or over dead center and stops the linkage at a point where the maximum force that will ever be required for sizing the largest cases is still obtainable. These two new, but not exclusive new characteristics, permit making the press frame out of a relatively light weight, low strength and inexpensive material such as zinc or aluminum. A collateral benefit of this is that the press frame can now be die cast to optimize productivity and reduce cost as compared with the conventional casting and fabricating methods that are used to make reloading press frames at the present time.

The press has other significant new features. One is that the length of the manually swingable operating lever can be adjusted so that when small caliber cartridge cases are being operated on in the press where low mechanical advantage is required, the operating arm need not be moved through a long arc in which case operator fatigue and cartridge case processing time are both reduced.

Another important feature of the new press is that the pivot axes for the ram actuating linkages and the manual operating lever are at an angle relative to a vertical plane through an O-shaped frame so that the frame will not be in the line of sight from the eyes of the user to the case being worked on.

How the foregoing and other objects of the invention are achieved will be evident in the ensuing more detailed description of a preferred embodiment of the invention which will now be set forth in reference to the drawings.

DESCRIPTION OF THE DRAWINGS

FIG. 4 is a vertical section taken on the irregular line 4—4 in FIG. 3;

FIG. 5 is an exploded view of the press parts;

FIG. 6 is a top view of the press; and

FIG. 7 is a diagram useful for explaining one of the two ways that the stress on the press O-frame is limited.

DESCRIPTION OF A PREFERRED EMBODIMENT

Figure 1:
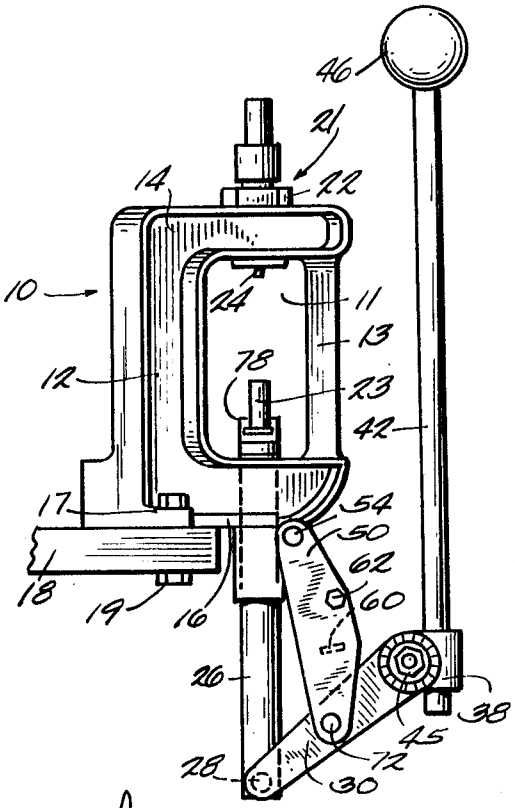
FIG. 1 is a side elevation view of the cartridge case reloading press where the operating lever is in its uppermost position and the case transporting ram is in its lowermost position.

Referring to FIGS. 1 and 5, the press comprises a frame generally designated by the numeral 10. The frame will be referred to as an O-frame to indicate that it is provided with a central opening 11 defined by upright side members 12 and 13 and top and bottom members 14 and 15. Members 11–15 form a unitary frame that is made by die casting it out of a relatively low strength and light weight metal such as aluminum or zinc. Aluminum is preferred for economic reasons. The lower member 15 of the O-frame has a flange 16 formed on it and the flange has slotted flanges or feet 17 which facilitate bolting the frame to a table top 18 by means of bolts 19 as illustrated in FIG. 1.

The top member 14 of the O-frame has an internally threaded vertical bore 20 as shown in FIG. 5 for receiving an externally threaded die 21 which is shown in FIG. 1. The die is locked by means of a lock nut 22. The die 21 which is presently in the press is for driving out the spent percussion cap of a case 23 and for resizing the case. Thus, the die 21 is provided with a center pin 24 that drives out the cap when case 23 is forced into the die and it has an interior configuration, not visible, that conforms to the shape of the case.

As shown in FIG. 5, lower member 15 of the O-frame is provided with a vertical through-hole 25 which is unthreaded and serves as a bearing sleeve for a vertically reciprocable ram 26. Die hole 20 and ram hole 25 are coaxial so ram 26 is aligned with the die. As shown in FIG. 5, the lower end of ram 26 has a diametral hole 27 for accommodating a pin 28. The pin 28 is for pivotally connecting complementary left and right parts 30 and 31, comprising a link, to ram 26. The similar left and right halves 30 and 31 constituting the link are provided at their ends with transverse bearing holes 32 and 33. Pin 28 pivotally connects the facing link parts to the ram 26 by passing through ram hole 27 and entering blind holes 32 and 3 as shown in FIG. 5.

Figure 3:
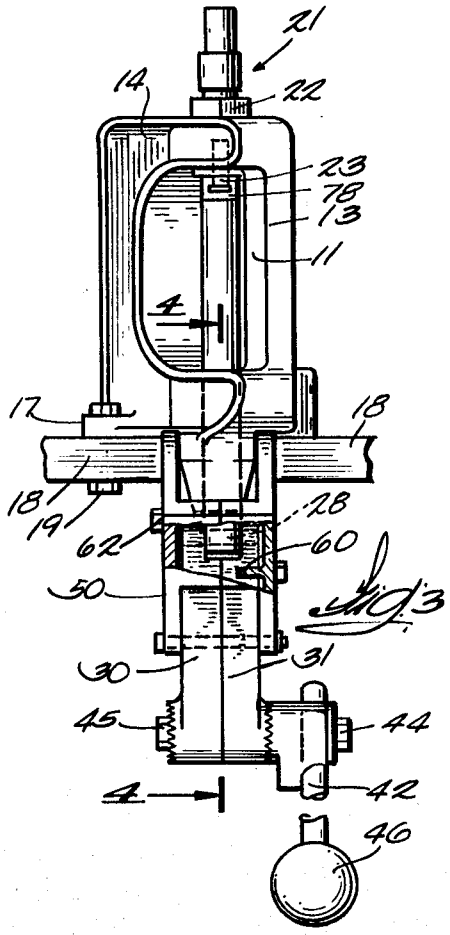
FIG. 3 is a front elevation view of the press with a part broken away to enable exhibiting the stop which prevents the linkage from assuming a position that would result in the ram reaching or passing dead center.
Figure 2:
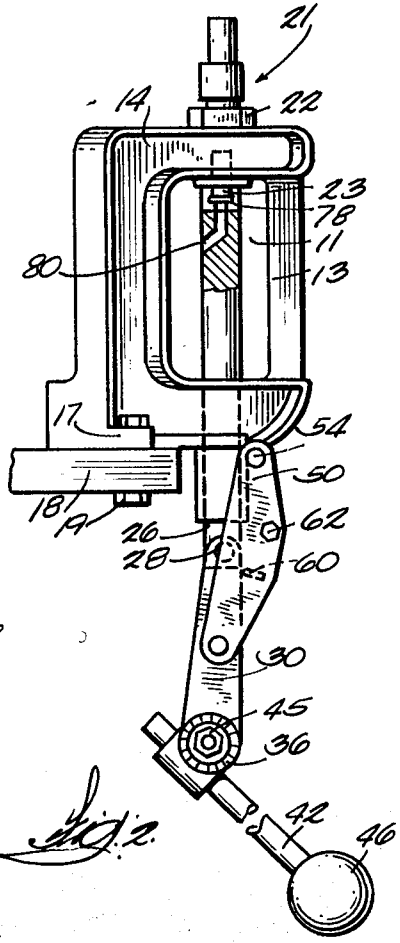
FIG. 2 is a side elevation view of the press wherein the operating lever has been swung clockwise relative to FIG. 1 and the ram is in its uppermost or working position.

As shown in FIG. 5, link halves 30 and 31 have transverse holes 34 and 35 that are surrounded by serrations 36 and 37. A handle clamping element 38 also has a central hole 39 surrounded by serrations 40. Clamping element 38 has a semi-circular groove 41 that has a diameter substantially equal to the manual operating lever or arm 42 which is shown in FIG. 1. Arm 42 has a ball 46 fixed on its end for the user to grip the arm. When handle arm 42 is fitted into groove 41 it can be clamped in any position by applying pressure to a clamping disk 43 by means of a bolt 44 that passes through the hole in the clamping disk and holes 39, 35 and 34 of the links. The serrations 40 on the clamping element are held in registry with the serrations 37 on the link 31 by tightening a nut 45 on the threaded end of bolt 44 after it has passed through hole 34 in link half 30 as can be seen in FIG. 2. Serrations 40 on the clamping element 38 and on link half 31 permit engaging the clamping element and link at any desired angular relationship with each other such that the manual operating arm 42 can be positioned at any desired angle. A pair of congruent toggle link halves 50 and 51 constitute together a toggle link which, in conjunction with link halves 30 and 31, form a compound lever system. As shown in FIG. 5, there is a projection 52 formed on an integral O-frame 10. This projection has a bore 53 whose axis would intersect a vertical plane through frame 10 at an angle other than perpendicular. In other words, the axis of hole 53 is askew with respect to the plane of the frame. Link halves 50 and 51 are pivotally connected to projection 52 by means of a pin 54 which passes through hole 55 of link part 50 and then through bore 53 of the projection and through hole 56 of link part 51. Pin 54 is grooved at its end and is retained by means of a snap ring 57.

Link parts 50 and 51 each have a boss 58 and 59 projecting integrally from them. A stop lug 60 is formed on the boss. The links are clamped together by means of machine screws, one of which 62 is shown in FIG. 5. It passes through a hole 63 in link 50 and threads into a hole 64 in link 51 to thereby clamp the link element together. The other clamping screw, not shown, extends through a clearance hole in boss 59 and screws into a threaded hole in boss 58. There will be a further discussion of the stop lug 60 feature.

Link halves 50 and 51 have corresponding holes 70 and 71 for pivotally connecting matching toggle links 50, 51 to matching links 30, 31. As can be seen in FIG. 5, links 30, 31 are provided with through-holes 73 and 74. Thus, to make the pivotal connection, holes 70, 73, 74 and 71 are aligned and pin 72 is inserted and retained by means of a snap ring 76. Note in FIG. 5 that at the upper end of ram 26 there is a conventional slotted case holder 78 and in FIG. 1 a spent case 23 is shown mounted in the holder.

FIG. 1 shows the ram 26 retracted with case 23 spaced from the primer removing and resizing die 21. In FIG. 2, the manual operating arm 42 has been rotated clockwise and, through the action of links 50 and 30, ram 26 has been driven upwardly to force the cartridge 23 into die 21 for removal of the primer cap and resizing. As shown in FIG. 4, ram 26 has a vertical hole 80 through which the spent primer may be discharged after being pressed out of the head of the cartridge. The linkages comprising the compound lever for driving ram 26 by swinging manual operating arm 42 is basically the same as the compound lever system described in the Huntington, et al., U.S. Pat. No. 2,847,897, dated Aug. 19, 1958. In this patent and in many of the commercially available reloading presses that use this linkage, sufficient motion of the manual operating arm 42 is permitted to have the toggle links 30, 31 toggle into dead center position at which time the ram 26 is also at dead center position and at its maximum height. In prior art reloading presses, letting the linkage toggle to dead center is the underlying cause of breakage and damage to the press frame and its components. As the ram 26 gets very close to top dead center it moves only a tiny distance toward the end of its stroke while at the same time the manual operating arm 42 is moving in an arc through a great distance. The linkage has a variable mechanical advantage. At midrange, the mechanical advantage is simply the length of the lever on one side of the pivot 72 divided by the length of the lever on the other side. However, as the lever passes dead center, the mechanical advantage becomes infinite. Now, if the die 21, especially a resizing die is screwed too deeply, it will be struck by the ram or the case 23 thereon when mechanical advantage is at its maximum. In some prior presses an unnecessarily large force of as much as 40 tons can be created at top dead center because of the absence of any means for limiting the mechanical advantage or the force that can be transmitted from the manual operating lever 42 through the linkages.

In applicants' press, however, as can be seen in FIGS. 2 and 4, the stop lug 60 carried on link 50 is so positioned that the lug reaches the toggle link 31 at a time before the linkage has toggled to top dead center. In an actual embodiment, stop lug 60 is so positioned that linkage motion is stopped when the ram is close enough to top dead center for it to produce a force of about 3,000 pounds (1.5 tons) which is far below the many tons of force that can be developed in prior art presses. In the commercial embodiment of the press described herein, by way of example and not limitation, the frame is designed for withstanding an ultimate force of about 5,000 pounds so there is still a good margin of safety over the maximum force that can be developed in the ram. Thus, even though the O-frame 10 is die cast with a low strength metal such as zinc or aluminum the sides and ends 12–15 of the O-frame can still have small cross-sections.

The FIG. 7 diagram illustrates the action of stop lug 60. It strikes the toggle link 31 before links 51 and 30 can toggle into dead center position. If stop lug 60 were absent, the linkage could swing further to dead center. At dead center, the central axes of pivot pin 54, link pin 72 and the ram connecting pin 28 would all lie on a dash-dot line 85. Link 30 would swing to its dashed line position in FIG. 7 in the absence of the stop lug. In accordance with the invention, with stop lug 60 present, pin axes 54, 28 and 72 can never lie on the same line 85 and, hence, dead center can never be attained. Thus, mechanical advantage is limited in this example to 40:1.

In accordance with the invention, the second means for limiting the force that can be developed in the ram or, in effect, limiting the input force to the system, is by using an operating arm 42 that tends to flex when a force in excess of a predetermined force is applied to it. For instance, an operating arm 42 which has a cross-section is used such that it will yield or bend if excessive force is applied as might be the case where the stop lug 60 has already contacted the toggle link to limit the force that can be transmitted to the linkage. In a case where the die 21 is grossly misadjusted, the ram or the case thereon may come to a stop against a sizing die, for instance, even before the stop lug 60 touches the toggle link. In such case excessive resistive force would be encountered while substantial force is still being applied to the operating arm 42, and if the user does not exercise good judgment, the arm 42 could bend and take a permanent set. This certainly signals the user that too much force has been applied, although if the arm 42 is bent, the press is still operative. However, in actual use the user would feel the deflection or springiness in the manual operating arm 42 and relieve the manually applied force so as to not go so far as to bend the arm 42. In any case, slight deflection of the arm is a signal to the user that an unnecessarily high force is being applied and that the die should be adjusted further away from the ram so no more than the minimum force for resizing can be developed. In an actual embodiment, by way of example and not limitation, operating arm 42 is made of one-half inch round steel that has a tensile strength of 78,000 pounds. The dimensions of the linkages are such that mechanical advantage is limited to 40:1. When the operating arm 42 is adjusted to its maximum length in clamp 38, arm 42 is effectively 13 inches long. A force in excess of 75 pounds will give the user a feeling that the operating arm 42 is deflecting because of its springiness. Nevertheless, at a manually applied force of about 75 pounds and a mechanical advantage of 40, a force of 3,000 pounds can still be developed on the ram and this is sufficient for sizing the full length of the case which requires the greatest force of all of the reloading operations.

As mentioned earlier, operating arm 42 is adjustable in length by virtue of the fact that it is clamped in clamping element 38 by means of bolt 44. This bolt can be loosened and the operating arm 42 can be slid axially to give it any effective length desired. Operating arm 42, as seen in FIG. 1, is really an extension of linkage 30 that turns on pivot 72. Thus, in FIG. 1, if the operating arm 42 is pushed downwardly in clamp 38, the length of the lever arm from pivot 72 is effectively shorter and mechanical advantage of the compound lever system is reduced. An appropriate time to shorten arm 42 is when small cases 23 are being processed in the press in which case a force necessary for sizing the case is relatively low. By shortening the arm 42, the user need not swing it through such a long arc in which case the ram 26 will move faster than when the arm is fully extended and cases can be processed more rapidly. The shorter arm, of course, reduces fatigue by the operator since the outer end is swung through a shorter arc.

FIGS. 5 and 6 show that the vertical member 13 of the O-frame 10 is narrower than the rear vertical member 12. This is to provide a clearer line of sight by the user to the ram for depositing and removing cartridges. This feature is enhanced by the fact, clearly visible in FIG. 6, that the pivot axis 54 is at an angle relative to the frame 10 so it is easier to see into the center opening 11 of the O-frame. Moreover, as is evident in FIG. 6, the operating arm 42 that has the wooden ball 46 on its end can easily swing past the side of the O-frame with good clearance.

Experience has shown that the new press is virtually unbreakable as a result of limiting both the mechanical advantage and possible input force with the combination of stopping the linkage before dead center is reached and having the operating arm flex or bend. Other mechanisms could be used to limit the input force in place of using a yieldable manual operating arm. For instance, the arm could be connected to the linkages through a shear pin, not shown, or shear pins could be used in other pivotal connections in the linkage. A spring loaded clutch could also be used. Although the latter mechanisms would serve the purpose, they are more expensive, complicated and inconvenient than the flexing operating arm.

Although a preferred embodiment of the invention has been described in detail, such description is intended to be illustrative rather than limiting, for the invention may be variously modified so its true scope is to be determined only by interpretation of the claims which follow.

We claim:

1. A cartridge case reloading press comprising:

a frame including a member for supporting a die, a ram for retaining a case and guided for travelling reciprocally toward and away from said member, toggle links pivotally connected to each other and respectively pivotally connected to said frame and said ram, and a manual operating arm connected to one of the links and swingable in one direction to pivot the links toward the position at which said links could toggle and drive said ram sufficiently far for the ram to apply maximum force to said member through the agency of a case, and swingable in an opposite direction to drive the ram away from said member, and means for stopping the pivotal motion of said links when said arm is being swung in said one direction before said links reach said toggling position to thereby prevent said toggling and prevent imposing said maximum force on said member.

2. The press according to claim 1 wherein said operating arm has such cross section and length as to flex and yield when there is a predetermined resistive force on said ram that is substantially lower than said maximum force.

3. The press according to any one of claims 1 or 2 wherein said frame is a die casting compound of a selected one of zinc or aluminum.

4. A cartridge case reloading press including:

a generally O-shaped frame defining an opening, means for holding a die on one side of the frame, a ram guided for sliding in the opposite side of said frame across said opening toward and away from said one side, said ram having means for supporting a case that is to be driven into a die, a first toggle link having one end pivotally connected to the nominally lower end of said ram, a manual operating arm and means at the other end of said first link for clamping said operating arm to the first link, a second toggle link having one end pivotally connected to said frame and another end pivotally connected to said first link between the pivot at the lower end of the ram and the means for fastening said arm to the second link, swinging said arm in one direction thereby causing said links to pivot and drive said ram until said links start to toggle toward dead center condition, wherein said ram would apply maximum force to said frame through said cartridge, and swingable in the opposite direction to retract said ram, and means for stopping the swinging movement of said second link substantially before dead center is achieved to thereby limit the force developed in the ram to a predetermined force substantially below said maximum force.

5. The press according to claim 4 wherein said operating arm is comprised of a steel rod having such cross section and length as to flex and yield when a force is applied to said arm that would result in greater than said predetermined force being developed.

6. The press according to claim 4 wherein said means for fastening said operating arm to said first link comprises a clamping member having a groove for receiving said operating arm and means for releasably clamping said member against said link to thereby provide for adjusting the effective length of said operating arm.

7. The press according to claim 4 wherein the pivot axes of said links are parallel to each other and are askew to a vertical plane passing centrally through said O-shaped frame such that said operating arm can swing to the side of the frame and the line of sight from a user's eyes at the front of the press to the opening in said frame will be less obstructed.

8. The press according to claim 5 wherein the lengths of said links and operating arm are such that a maximum mechanical advantage of about 40 will exist such that when a force up to 75 pounds is applied to the free end of said operating arm the maximum force on said ram will be about 3,000 pounds.

9. The press according to one of claims 4, 5, 6, 7 or 8 wherein said O-shaped frame is a die casting composed of a selected one of zinc or aluminum.

10. A cartridge case reloading press comprising:

a frame including a member for supporting a die, a ram for retaining a case and guided for travelling reciprocally toward and away from said member, toggle links pivotally connected to each other and respectively pivotally connected to said frame and said ram, and a manual operating arm connected to one of the links and swingable sufficiently in one direction to pivot the links through an angular range during which the pivot axes of said links could align and drive said ram to the limit at which the ram would apply maximum force to said member through the agency of a case and swingable in an opposite direction to drive the ram away from said member, said links being constructed and arranged to abut when said links have pivoted through a part of said angular range resulting from said operating arm being swung in said one direction, said abutment occurring before said pivot axes of said links align to thereby prevent further pivoting and imposing said maximum force on said member.

11. The reloading press according to claim 10 wherein said operating arm is a steel rod having such cross section and length as to flex and yield when said ram is resisted by a predetermined force whether said force is developed before or at the time said links abut.

* * * * *